United States Patent [19]

Rudy

[11] 4,302,063

[45] Nov. 24, 1981

[54] METHOD FOR VAPORIZING GETTER MATERIAL IN A VACUUM ELECTRON TUBE

[75] Inventor: William G. Rudy, Lancaster, Pa.

[73] Assignee: RCA Corporation, New York, N.Y.

[21] Appl. No.: 125,646

[22] Filed: Feb. 28, 1980

[51] Int. Cl.[3] ..... H01J 7/18

[52] U.S. Cl. ..... 316/25; 316/3

[58] Field of Search ..... 316/3, 25

[56] References Cited

U.S. PATENT DOCUMENTS

| | | | |
|---|---|---|---|
| 3,508,105 | 4/1970 | Pappadis | 313/178 |
| 3,558,962 | 1/1971 | Reash | 313/180 |
| 3,964,812 | 6/1976 | Turnbull | 316/25 |
| 3,996,510 | 12/1976 | Guichard | 324/41 |
| 4,042,876 | 8/1977 | Visioli, Jr. | 324/34 D |

*Primary Examiner*—Joseph H. McGlynn

*Attorney, Agent, or Firm*—E. M. Whitacre; G. H. Bruestle; L. Greenspan

[57] ABSTRACT

Method for vaporizing getter material from a container inside a vacuum electron tube comprises (a) sensing the location of the container from outside the tube, (b) generating signals indicating that location, (c) positioning an induction heating coil outside the tube opposite the container, (d) energizing the positioned heating coil and (e) using the generated signals to control the energizing step.

8 Claims, 2 Drawing Figures

METHOD FOR VAPORIZING GETTER MATERIAL IN A VACUUM ELECTRON TUBE

BACKGROUND OF THE INVENTION

This invention relates to a novel method for vaporizing getter material inside a vacuum electron tube and particularly, but not exclusively, to a novel method for flashing the getter material from a getter container in a color television tube.

In one popular design of a color television picture tube, which is a type of cathode-ray tube, a getter container having getter material therein is held against or close to the inner surface of the envelope, usually that part of the envelope called the funnel. After the envelope is evacuated of gases and sealed, an induction coil is positioned against or close to the outer surface of the envelope opposite the getter container and is then energized with a high-frequency current. The magnetic field generated by the energized coil induces currents in the getter container causing the temperature of the getter container and the getter material therein to rise rapidly until getter material, which is usually barium metal, vaporizes or "flashes" and deposits as a getter film on internal surfaces of the tube. A purpose of the getter film is to absorb both residual gas left in the envelope after evacuation and adsorbed gas that is later evolved from internal surfaces during the operating life of the tube. The life of the tube is determined principally by the ability of the getter film to continue to absorb gas and to maintain a low gas pressure in the envelope.

In order to vaporize the maximum amount of getter material from the container and to realize a desired distribution of deposited getter material in the tube, it is necessary to position the induction coil properly with respect to the getter container to produce optimum magnetic coupling between them. This is not easily done. Although the envelope is usually constituted of a transparent glass, the getter container cannot be seen (optically) from outside the tube because the inner surface of the envelope opposite the getter container is coated with an opaque conductive coating.

Heretofore, it was the common procedure to make a dummy tube without any opaque wall coating present, and then to determine where the induction coil should be located on tubes of that design in order to flash the getter material from the getter container. Since, during factory production, there is some variation from the nominal position of the getter container, this prior procedure results in a corresponding variation in the amount and uniformity of the deposited getter material. To compensate for misalignment between the induction coil and the getter container, a large, flat "pancake" coil is used. However, while the use of a large, flat coil insures the flashing of the getter material, it never creates the uniform heating in the getter container for realizing the best control of the getter-flashing method.

SUMMARY OF THE INVENTION

In the novel method, as in prior methods, the getter container is held against or close to the inner surface of an evacuated electron-tube envelope, which may carry an opaque coating thereon. Also, an induction coil that is positioned adjacent to the outer surface of the envelope opposite the container is energized to heat the container. In the novel method, unlike prior methods, the location of the getter container is sensed from outside the envelope prior to energizing the induction coil, and signals are generated which indicate that location. These signals are used to control the step of energizing the induction coil. For example, the signals may be used to permit the induction coil to be energized only when the induction coil is in a prescribed range of positions with respect to the container. Or, the signals may be used to position the container within a prescribed range of locations adjacent to the outer surface of the envelope opposite the getter container.

The novel method avoids most of the variability in the positioning of the induction coil relative to the getter container that is experienced with prior getter-vaporizing methods. Instead, the position of the getter container, regardless of the variability ordinarily encountered in assembling the tube, is positively sensed from outside the tube, and the induction coil may be energized when it is positioned with respect to this sense. With better positioning of the coil with respect to the container, a higher yield of getter material can be realized, a preferred distribution of getter material can be realized, smaller induction coils can be used, and lesser amounts of electric power can be used.

DESCRIPTION OF THE PREFERRED EMBODIMENT

Getters and their use in electron tubes are well known. Getters and their use in cathode-ray tubes in particular need not be described in detail here since they have been described previously; for example, in U.S. Pat. Nos. 3,508,105 issued Apr. 21, 1970 to N. P. Pappadis, 3,558,962 issued Jan. 26, 1971 to C. W. Reash, 3,964,812 issued June 22, 1976 to J. C. Turnbull and 4,045,849 issued Sept. 6, 1977 to E. S. Thall.

Figure 1:
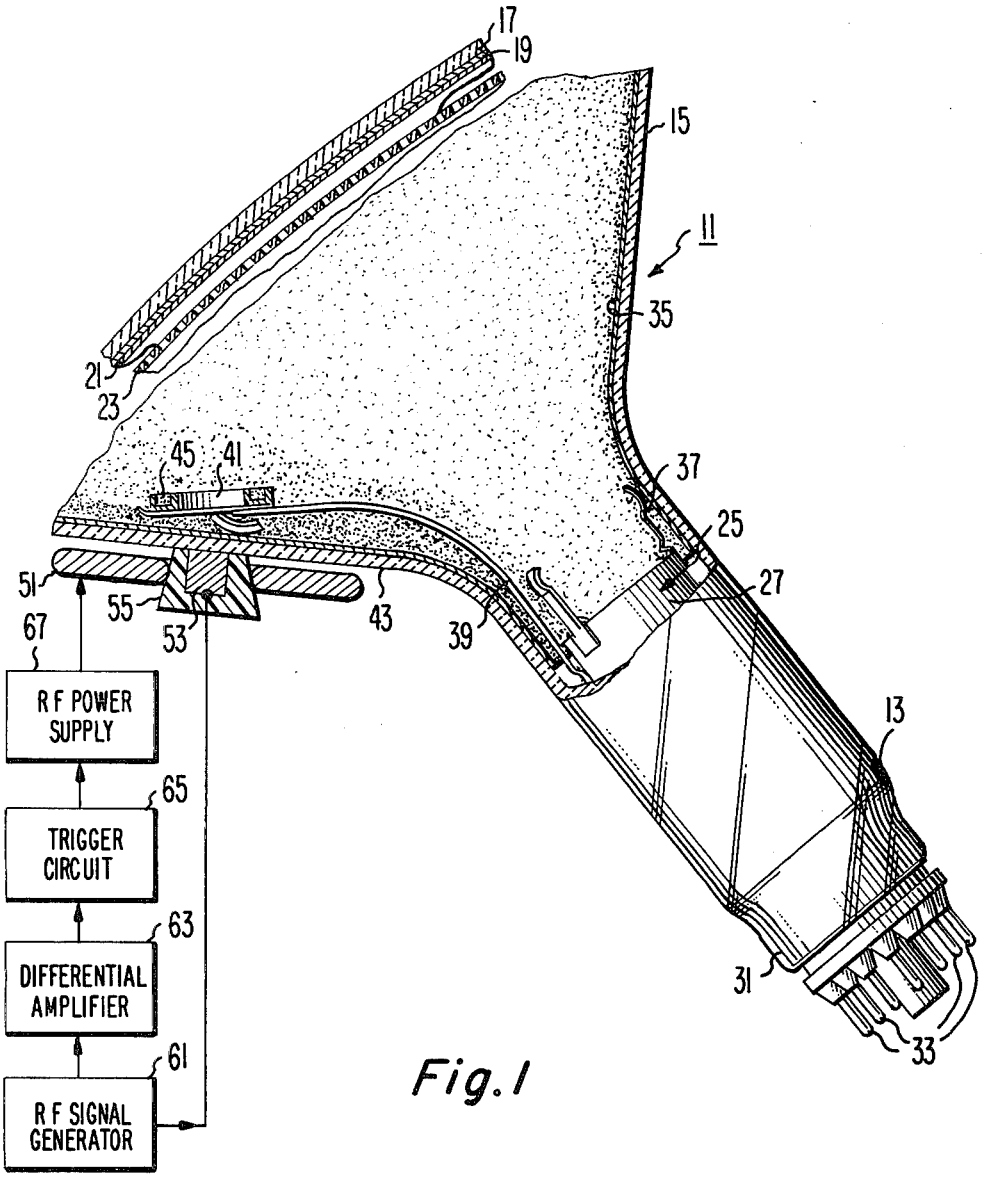
FIG. 1 is a fragmentary view, partially in crosssection, of a cathode-ray tube, having the getter container in position for induction heating prior to vaporizing the getter material therein.

FIG. 1 shows so much of a color television picture tube, which is a type of cathode-ray tube, as is necessary for understanding the novel method. The tube comprises an evacuated envelope 11 including a cylindrical neck 13 extending from the small end of a funnel 15. The large end of the funnel 15 is closed by a faceplate panel 17. A tricolor mosaic screen 19, which is backed by a reflecting metal layer 21 of aluminum metal, is supported on the inner surface of the panel 17. The screen comprises a multiplicity of trios, each comprising a green-emitting, a red-emitting and a blue-emitting element. A shadow mask 23 is supported within the envelope close to the screen to achieve color selection. The mask is a metal sheet having a generally dome-shaped configuration and is provided with an array of apertures which are systematically related to the trios of the screen 19. An electron-gun mount assembly 25 comprising an array of three similar electron guns is mounted in the neck 13. The mount assembly includes a convergence cup 27, which is that element of the mount assembly closest to the screen 19. The end of the neck 13 is closed by a stem 31 having terminal pins or leads 33 on which the mount assembly 25 is supported and through which electrical connections are made to various elements of the mount assembly 25.

An opaque, conductive funnel coating 35 comprising graphite, iron oxide and a silicate binder on the inner surface of the funnel 15 is electrically connected to the high-voltage terminal or anode button (not shown) in the funnel 15. Three bulb spacers 37 are welded to and connect the convergence cup 27 with the funnel coating 35. The bulb spacers 37, which are preferably made of spring steel, also center and position the extended end of the mount assembly 25 with the longitudinal axis of the tube.

A getter assembly comprises an elongated spring 39, which is attached at one end to the cup 27 of the mount assembly 25 and extends in cantilever fashion into the funnel 15. A metal getter container 41 is attached to the other extended end of the spring 39, and a sled including two curved runners 43 is attached to the bottom of the container 41. The container has a ring-shaped channel containing getter material 45 with a closed base facing the inner wall of the funnel 15. The spring 39 is a ribbon of metal which urges the base of the container 41 outwardly toward the funnel wall with the runners 43 contacting the coating 35. The length of the spring 39 permits the container 41 to be psoitioned well within the funnel 15, where the getter material can be flashed (vaporized) to provide optimum coverage and where the spring 39 and container 41 will be out of the paths of the electron beams issuing from the mount assembly 25 and not interfere with the operation of the tube.

As shown in FIG. 1, the tube is assembled and the envelope has been evacuated of gases and hermetically sealed. This may be achieved by any of the known fabrication and assembly processes. However, the getter material has not been vaporized in the getter container 41. In this embodiment, the getter container 41 holds a mixture of nickel and a barium-aluminum alloy, which upon heating reacts exothermically, vaporizes barium metal and leaves a residue of an aluminum-nickel alloy in the container 41.

To "flash" the getter; that is, to cause the exothermic reaction to take place, use is made of an induction heating coil 51 which is detachably coupled to a sensor coil 53 with a spacer 55. The sensor coil 53 is of known construction for proximity sensing of an electrically-conducting mass. The sensor coil 53 is energized with a high-frequency alternating current, for example, 100 kilocycles, from an RF signal generator 61. The current through the sensor coil 53 produces an alternating magnetic field that induces eddy currents in a nearby conducting mass. The induced eddy currents produce magnetic fields that are opposite to the field due to the current in the sensor coil 53 according to Lenz's law which states that whenever a current is set up by a change of flux through a circuit, its direction will be such as to create a field to oppose the field which caused the current. This results in a reduction in the inductance of the sensor coil 53. The closer the mass to the coil 53, the greater is the reduction in the inductance of the coil 53.

Thus, with an impedance in the circuit of the sensor coil 53, the presence of the getter container 41 presents a reflected load which reduces the voltage across the sensor coil 53. This voltage is the signal indicating the presence of the container 41. The reduction is a maximum when the axes of the sensor coil 53 and container 41 are coincidental, with a minimum separation distance between sensor coil 53 and container 41. This primary signal is inverted; that is, the signal is subtracted from some nominal value to produce a difference signal. This difference signal is produced and amplified in the differential amplifier 63, whose output passes to a trigger circuit 65, such as a Schmitt trigger. If the amplified difference signal is high enough, it will activate the trigger circuit 65 to signal that the sensor coil 53 is within a prescribed range of positions with respect to the getter container 41. As shown in FIG. 1, the induction coil 51 is also positioned with respect to the container 41. The sensor coil 53 is withdrawn, and the power supply 67 is activated or permitted to be activated either manually or automatically as from the trigger circuit 65 to energize the induction coil 51. The induction coil 51, by induction, will heat the getter container 41 and its contents 45 rapidly until the contents flash, releasing barium vapor, which deposits principally on the mask 23 and portions of the opaque coating 35 opposite the getter container 41.

A key element in the preferred detection system is the bistable trigger circuit 65 commonly referred to as a Schmitt trigger. In this application, its role is to take the gradually-changing difference signal which has been amplified and, at or above a predetermined value, produce an abrupt change in an output or control signal. As the sensor coil 53 moves closer to the getter container 41, the sensor coil 53 produces a smaller primary signal with a minimum signal when the sensor coil 53 is directly over and coincident with the getter container 41. However, the difference signal produced from this primary signal is maximum when the sensor coil 53 is directly over and coincident with the getter container 41.

Figure 2:
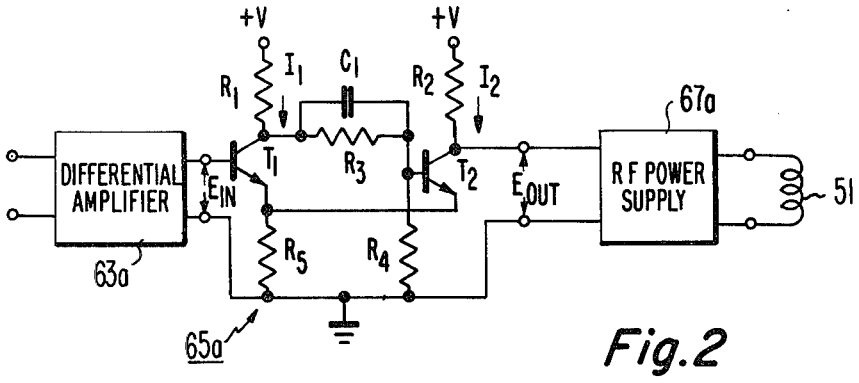
FIG. 2 is a diagram of a trigger circuit that may be used to practice the novel method.

FIG. 2 shows the typical circuit arrangement for a Schmitt trigger 65*a*, which receives an input signal $E_{in}$ from a differential amplifier 63*a*. Two npn transistors T1 and T2 are either in conducting or nonconducting states or combinations thereof. The voltage drop across the common cathode resistor R5 determines the state of the transistors T1 and T2. The resistors R2 and R5 are chosen such that when the input signal $E_{in}=0$, T1 is nonconducting (i.e., OFF) and T2 is conducting (i.e., ON). The output signal $E_{out}$ will then be $E_{out}=V-I_2R_2=I_2R_5$. Now as $E_{in}$ increases, there is no change in $E_{out}$ until a threshold voltage is reached and T2 is driven to the OFF or nonconducting condition. This occurs when T1 is driven to the ON (or conducting condition). Both T1 and T2 have a common R5, and as $E_{in}$ increases, a large positive feedback signal develops driving T1 to the ON state. Instantaneously, a large voltage drop occurs across R5 causing T2 to turn OFF. The output signal $E_{out}$ correspondingly jumps to $+V$. Thus, with a preset $E_{in}$ corresponding to the sensor output minimum, the instantaneous change in the output signal $E_{out}$ can signal the RF power supply 67 that the induction heating coil 51 has been properly located, and that the getter can be flashed.

One suitable power supply is induction heating generator T-2.5-1-KC11-B3W marketed by Lepel Corporation, Maspeth, N.Y. 11378. This generator is designed to deliver to the induction heating coil 51 2.5 kw of high-frequency energy in the range of 250 to 800 KHz. This generator includes a high-voltage DC power supply, a modified Hartley oscillator, a tapped tank coil and a control system. The control system is designed for manual operation or automatic operation. The output signal $E_{out}$ from the trigger circuit may be used directly or through a relay for automatic operation of the RF power supply 67*a*.

A preferred procedure for setting up the apparatus for practicing the novel method is as follows. A getter container is mounted adjacent a piece of flat glass plate whose thickness is equivalent to the thickness of the glass envelope wall where a getter container is to be mounted. The sensor coil 53 is detachably coupled to the heating coil 51. The coupled combination is positioned adjacent the opposite side of the plate with the heating coil 51 concentric with the getter container 41. With the sensor coil 58 so positioned, the current into the sensor coil 53 is adjusted so that the output of the coil just triggers the trigger circuit 65 to the ON condition. If the sensor coil is moved slightly out of concentricity, the trigger circuit 65 remains in or returns to the OFF condition.

With the apparatus so adjusted, the coupled induction coil 51 and sensor coil 53 can be scanned over the outer surface of a cathode-ray tube. When the sensor coil 53 finds the position where the heating coil is concentric with the getter container, the trigger circuit triggers to the ON condition. As shown in FIG. 1, this can be used to energize the heating coil 67 directly after withdrawing the sensor coil 53. Alternatively, the trigger in the ON condition can be used to stop the scanning movement of the sensor coil 53 and heating coil 41, and an operator can be alerted by bell or light. Then, the sensor coil 53 can be withdrawn and the heating coil 51 energized manually by the operator.

The following observations have been made with respect to the novel method:

1. The presence of the opaque conducting layer 35 prevents the getter container from being viewed visually from outside the tube but does not appear to interfere in any significant way with magnetic sensing as described above.

2. The novel method permits the induction heating coil to be positively and consistently located in an optimum position outside the tube for heating an electrically-conducting container inside the tube.

3. This optimum positioning provides consistently better magnetic coupling between the heating coil and the getter container. Thus, less power is required for flashing the getter.

4. Optimum positioning also results in more uniform heating of the getter container and better control over the exothermic chemical reaction which is more predictable if uniform heating is achieved. Through more uniform heating, a higher yield of vaporized getter material with the desired distribution can be achieved. Also, more uniform heating can result in reduced splashing and a reduction of loose particles in the tube, which particles may be a cause of arcing during the operation of the tube. Also, more uniform heating helps prevent burn-through of the getter container, which is believed to be due to extremely uneven heating of the getter container.

5. The getter container and the contents of the getter container may be any of the systems known in the art of gettering. For example, any of the systems described in the patents issued to Pappadis, Reash and Turnbull cited above may be used. It is preferred to use an alloy of constituents which react exothermically to yield a metallic getter material in vapor form. Barium metal vapor is preferred, although strontium or other metal vapor may be produced. Also, the alloy may yield, upon heating, controlled amounts of gas for the purpose of modifying the distribution and deposition of the vapor.

6. Systems are known for detecting an electrically-conducting body or mass by sensing the change or attenuation of the electrical load in a magnetic coil near the body or mass. U.S. Pat. Nos. 3,996,510 issued Dec. 7, 1976 to R. C. Guichard and 4,042,876 issued Aug. 16, 1977 to A. J. Visioli, Jr. are examples. Prior systems for proximity sensing of this type can be adapted with ordinary engineering skill for use in the novel method.

7. The novel method is described with respect to getter containers that are mounted to springs that are attached to the electron-gun mount assembly. The getter container may, alternatively, be mounted near or on the inner surface of the envelope from any other structure; for example, the anode button or the frame on which the mask 23 is mounted.

8. The novel method may also be used as a testing procedure on automated machines that practice the prior method in which the getter container is expected by calculation to be at a particular location. In that method, the induction heating coil is positioned automatically opposite the expected location. The novel method can be used to determine whether, in fact, the heating coil is opposite the getter container. The novel method can be applied from time to time to determine whether the mechanism for positioning the heating coil is in proper adjustment. Or, the method can be applied each time the method is to be practiced to prevent the induction heating coil from being energized if the getter container is not where it is expected to be, or if it is absent completely from the tube.

I claim:

1. In a method for vaporizing getter material from a getter container located inside and adjacent the inner surface of the envelope of a vacuum electron tube, said method including (i) positioning an induction coil adjacent the outer surface of said envelope opposite said getter container (ii) and energizing the positioned induction coil so as to heat said getter container and to vaporize said getter material therefrom, the improvement comprising (a) sensing the location of the getter container from outside said envelope, (b) generating signals which indicate the location of said container (c) and using said signals to control said energizing step.

2. The method defined in claim 1 wherein said signal is used to permit said induction coil to be energized only when said induction coil is within a prescribed range of positions with respect to said getter container.

3. The method defined in claim 1 wherein the location of said getter container is sensed magnetically.

4. The method defined in claim 3 including mechanically coupling said induction coil with a sensor coil that is adapted for sensing a metal object that is proximate thereto, moving said coupled combination over said outer surface opposite said getter container, and using said signal to stop the movement of said coupled combination within a prescribed range of positions with respect to said getter container.

5. The method defined in claim 3 including mechanically coupling said induction coil with a sensor coil that is adapted for magnetically sensing a metal object that is proximate thereto, moving said coupled combination to a prescribed location adjacent said outer surface, and using said signal to permit said energizing step only when said combination is within a prescribed range of positions with respect to said getter container.

6. The method defined in claim 1 wherein said electron tube is a cathode-ray tube and said method includes (a) moving a mechanically-coupled combination of said induction coil and a proximity metal sensor coil adjacent the outer surface of said envelope opposite said getter container, (b) generating in said sensor signals which indicate the location of said container relative to said combination, (c) positioning said induction coil within a prescribed range of positions adjacent to said outer surface in response to said signals, (d) and then energizing said positioned induction coil to heat by induction said getter container and to vaporize said getter material therefrom.

7. The method defined in claim 6 including after step (c) and before step (d), uncoupling said sensor coil from said combination and removing said sensor coil from the vicinity of said induction coil.

8. The method defined in claim 6 wherein said sensor coil is connected to a circuit which is adjusted to activate a power source to energize said heating coil only when said heating coil is in said prescribed range of locations.

* * * * *